United States Patent [19]

Krajancich

[11] Patent Number: 4,674,450

[45] Date of Patent: Jun. 23, 1987

[54] INTERNAL COMBUSTION ENGINES

[76] Inventor: James D. Krajancich, Lot 31, Lefroy Avenue, Herne Hill, Western Australia, Australia, 6056

[21] Appl. No.: 702,686

[22] Filed: Feb. 19, 1985

[30] Foreign Application Priority Data

Feb. 29, 1984 [AU] Australia ..... PG3839

[51] Int. Cl.[4] ..... F02B 29/00; F02B 41/00

[52] U.S. Cl. ..... 123/79 A; 123/79 R; 123/316

[58] Field of Search ..... 123/79 R, 79 A, 316, 123/405

[56] References Cited

U.S. PATENT DOCUMENTS

| | | | |
|---|---|---|---|
| 1,259,728 | 3/1918 | Eastman | 123/79 A |
| 1,992,721 | 2/1935 | Smith | 123/79 R |
| 2,046,264 | 6/1936 | Hesselman et al. | 123/279 X |
| 2,817,322 | 12/1957 | Miller | 123/316 |
| 3,071,123 | 1/1963 | Gromme | 123/79 A |
| 3,986,351 | 10/1976 | Woods et al. | 123/316 X |

FOREIGN PATENT DOCUMENTS

| | | | |
|---|---|---|---|
| 78561 | 3/1919 | Austria | 123/79 R |
| 2255466 | 7/1975 | France | 123/79 A |
| 2455175 | 12/1980 | France | 123/79 R |
| 586703 | 3/1947 | United Kingdom | 123/79 A |
| 632128 | 11/1949 | United Kingdom | 123/79 A |

*Primary Examiner*—Tony M. Argenbright

*Attorney, Agent, or Firm*—Reising, Ethington, Barnard, Perry & Milton

[57] ABSTRACT

The present invention provides an internal combustion engine comprising a combustion chamber, a piston mounted within the combustion chamber and arranged to be sealingly engaged with walls of the combustion chamber, the piston being arranged for reciprocating motion between a first position in which combustion chamber is of maximum volume and a second position in which the combustion chamber is of minimum volume, wherein the combustion chamber further comprises an inlet-outlet control valve means in a region of the combustion chamber within the minimum volume defined by the piston in its second position, a fluid fuel injection means in a region of the combustion chamber within the minimum volume defined by the piston in its second position, a combustible mixture ignition means located in the region of the combustion chamber within the minimum volume defined by the piston in its second position, and the engine comprises an antechamber comprising an inlet means and spent combustible mixture outlet means, which antechamber is in communication with the inlet-outlet control valve means of the combustion chamber.

12 Claims, 23 Drawing Figures

INTERNAL COMBUSTION ENGINES

The present invention relates to internal combustion engines. Internal combustion engines of conventional type typically comprise a combustion chamber having a piston mounted therein so as to be reciprocable between a first position in which the combustion chamber is of maximum volume and a second position in which the combustion chamber is of minimum volume.

The piston sealingly engages with walls of the combustion chamber.

Essentially, combustible fuel and air is drawn into or injected into the combustion chamber so that a charge of combustible mixture is contained in the combustion chamber The charge of combustible mixture is compressed by the piston as it moves to its second position.

At or adjacent the second position of the piston, the combustible mixture charge is ignited. This causes combustion of the combustible mixture charge and the production of hot combustion gases which expand rapidly and apply force to the piston. This force pushes the piston back towards its first position. The piston is subsequently used to exhaust the spent combustible mixture from the combustion chamber.

In order to admit air into the combustion chamber and to exhaust the spent combustible mixture from the combustion chamber, the combustion chamber contains an inlet valve means and a separate exhaust valve means. The inlet valve means and exhaust valve means in the case of a fourstroke engine each comprise one or more valves provided with an actuating mechanism arranged to cause the valve means to open and close at appropriate points in the cycle of the engine.

Further, the combustion chamber contains ignition means for the combustible mixture which ignition means may be in the form of a spark plug.

It has been found that existing internal combustion engines suffer from a number of problems.

For example, in a four stroke engine, the inlet valve means and exhaust valve means are, at some point in the cycle, both open at the same time. This is known as valve overlap and is necessary to achieve a satisfactory degree of charge of combustible mixture into the combustion chamber whilst exhausting spent combustible mixture at a high rate of engine revolutions. However, it is found that this valve overlap causes a part of the fresh charge of fuel to pass directly out of the exhaust valve means. This causes the exhaust gases to contain more unspent hydrocarbons than is necessary. This problem is even worse with two stroke engines.

Further, the passage of hot exhaust gases past the exhaust valve means cause the latter to become hot in use. This leads to an increase in the nitrogen oxide content of the exhaust gases. Also, if it is desired to use high compression ratios for increased efficiency, the hot exhaust valve means can cause detonation of the charge which is extremely damaging to engine components and leads to a drop in efficiency.

Still further, unless the spark plug is located centrally of the combustion chamber, it is found that inefficient combustion takes place. As a result, organic compounds such as hydrocarbons in the combustible mixture only burn partially. This increases the carbon monoxide content of the exhaust gases.

The present invention provides an internal combustion engine in which one or more of the above problems are reduced.

In accordance with one aspect of the present invention, there is provided an internal combustion engine comprising a combustion chamber, a piston mounted within the combustion chamber and arranged to be sealingly engaged with walls of the combustion chamber, the piston being arranged for reciprocating motion between a first position in which the combustion chamber is of maximum volume and a second position in which the combustion chamber is of minimum volume, wherein the combustion chamber further comprises an inlet-outlet control valve means in a region of the combustion chamber within the minimum volume defined by the piston in its second position, a fluid fuel injection means in a region of the combustion chamber within the minimum volume defined by the piston in its second position, a combustible mixture ignition means located in the region of the combustion chamber within the minimum volume defined by the piston in its second position, and the engine comprises an antechamber comprising air inlet means and spent combustible mixture outlet means, which antechamber is in communication with the inlet-outlet control valve means of the combustion chamber.

Preferably, the combustion chamber comprises a roof portion above the piston in all positions thereof, and the inlet-outlet valve means is located centrally of the roof portion. The inlet-outlet valve means may comprise a plurality of valves such as four valves, preferably disposed symmetrically about the roof portion of the combustion chamber. However, the inlet-outlet valve means preferably comprises a single valve.

More preferably, the ignition means is also located in the roof portion of the combustion chamber and for this purpose it is preferably centrally located. Where the inlet-outlet valve means comprises a single valve, this single valve is also preferably centrally located. In this case the ignition means preferably extends through the single valve means so as to have an ignition point in the combustion chamber at the inner end of the single inlet-outlet valve means.

The present invention will now be described, by way of example with reference to the accompanying drawings, in which.

Figure 7:
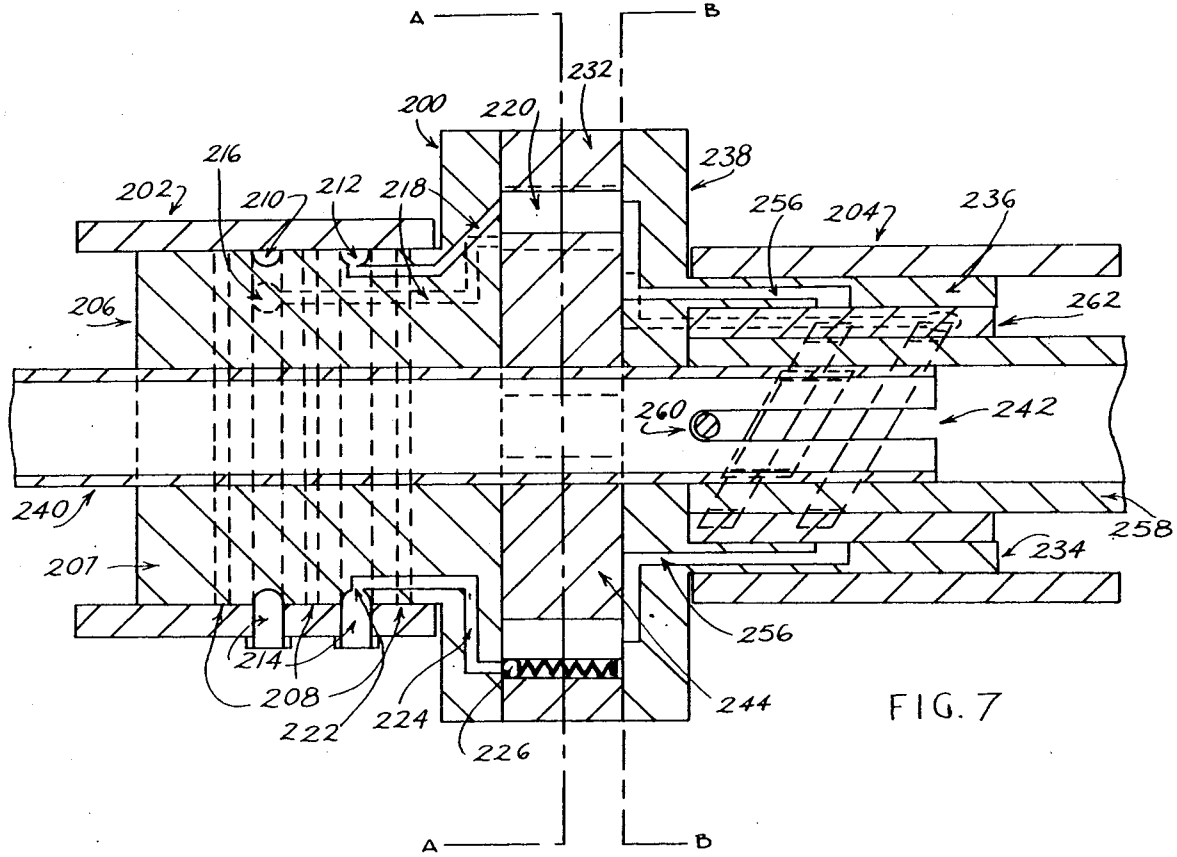
FIG. 7 is a sectional view of an hydraulic valve timing means for use with the internal combustion engine of the present invention.
Figure 10A:
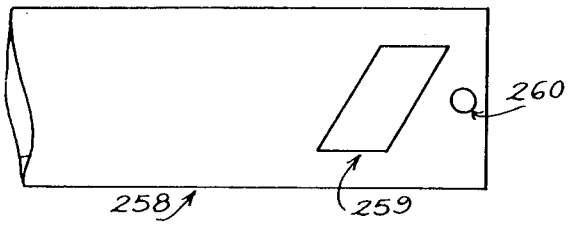
Figure 10B:
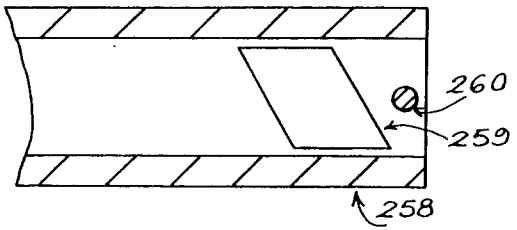
Figure 10C:
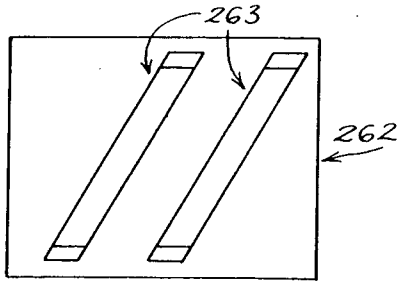
Figure 10D:
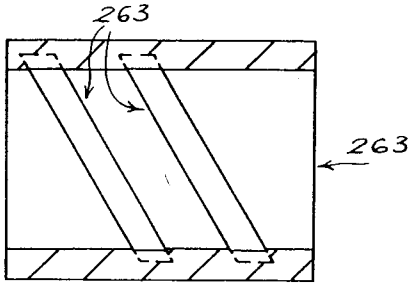
Figure 11:
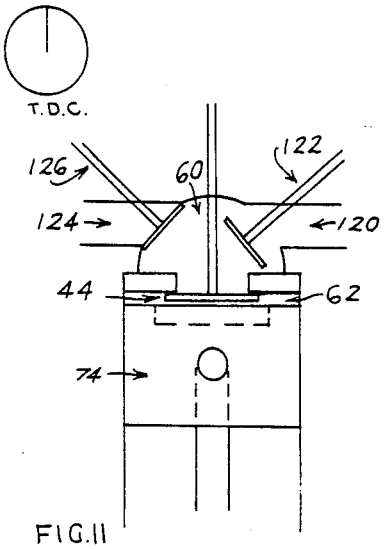
Figure 17:
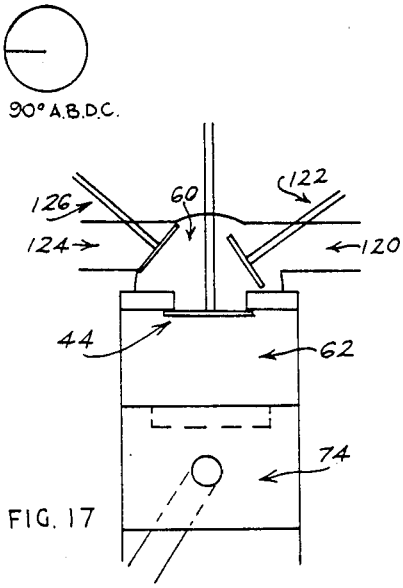
Figure 18:
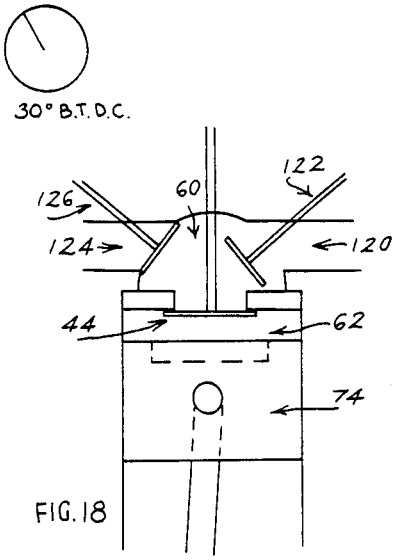
Figure 20:
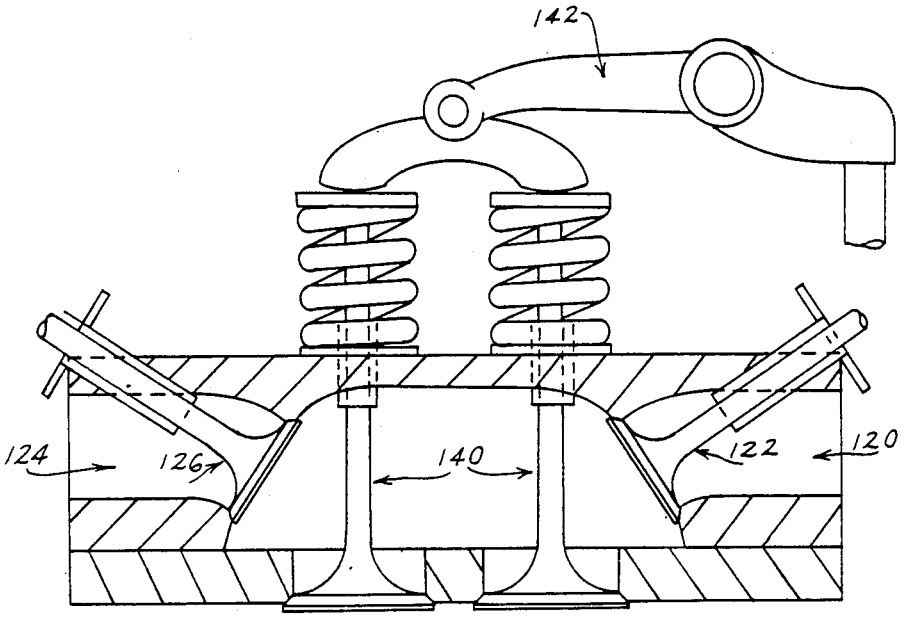
Figure 19:
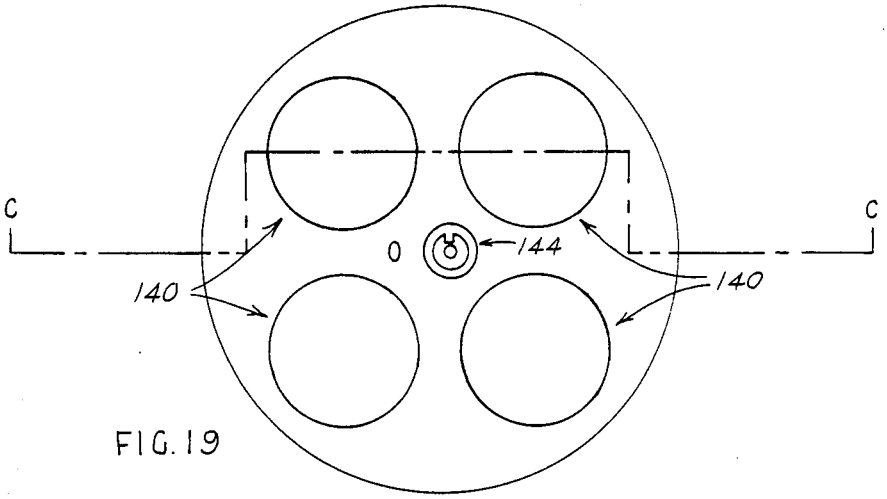

FIG. 10*a* is a side elevation of an end of a hollow shaft of the apparatus of FIG. 7 to show formed therein;

FIG. 10*b* is a sectional view through the shaft of FIG. 10*a* to show the opposite side thereof and a further slot formed in the shaft;

FIG. 10*c* is a side elevation of a sleeve of the apparatus of FIG. 7 to show a part of helical slots cut therein;

FIG. 10*d* is a sectional view through the sleeve of FIG. 10*c* to show the opposite side thereof and a further slot formed in the sleeve;

FIGS. 11 to 18 show an engine in accordance with the present invention in different positions to show valve movements, FIG. 19 is an underneath view of a further embodiment of cylinder head used in an engine according to the present invention; and FIG. 20 is a sectional view taken along the line C—C of FIG. 19.

Figure 1:
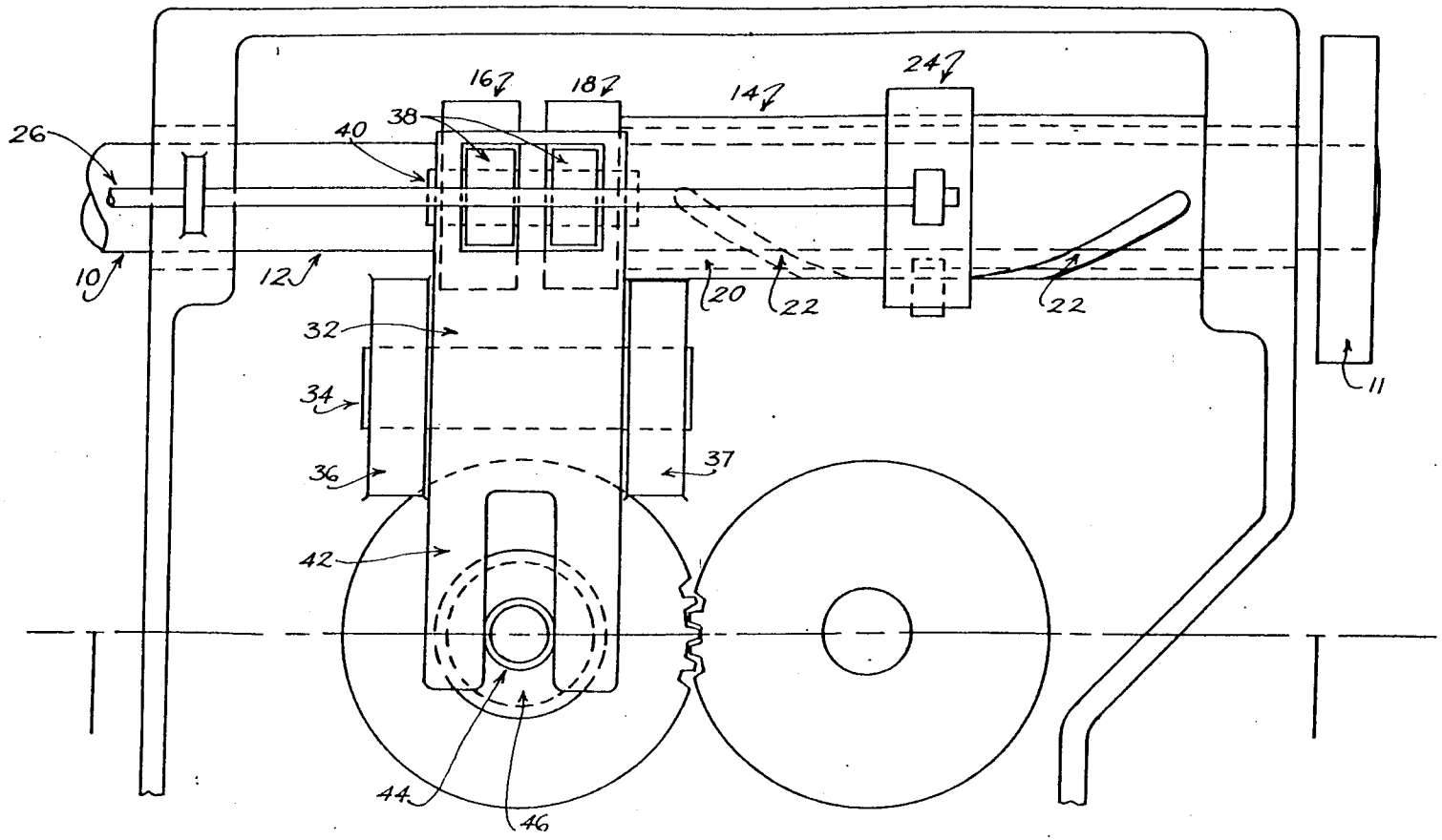
FIG. 1 is a plan view of part of a cylinder head of an internal combustion engine in accordance with the present invention.

In FIG. 1 of the drawings, there is shown a cylinder head for an internal combustion engine in accordance with the present invention. The cylinder head comprises a rotatably mounted shaft 10 connected to means such as a gear wheel 11 for causing it to rotate continuously during operation of the engine.

The shaft 10 comprises a first inner portion 12 and a second outer portion 14. The second outer portion 14 is mounted about the first inner portion 12 towards one end of the latter. A first cam lobe 16 is fixedly mounted to the first inner portion 12 whilst a second cam lobe 18 is fixedly mounted to the second outer portion 14.

Figure 4:
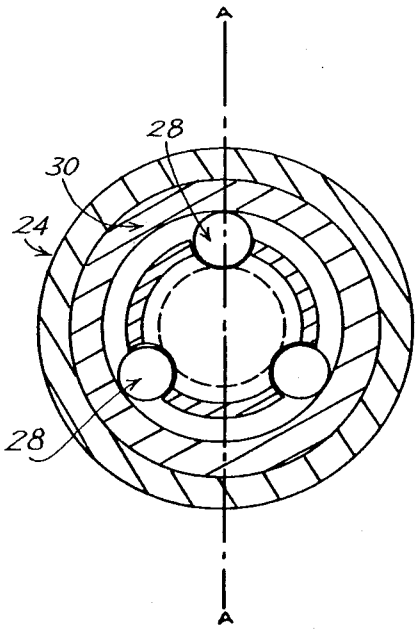
FIG. 4 is a transverse section through a portion of the cam advance mechanism of FIG. 3 along the line A—A.
Figure 3:
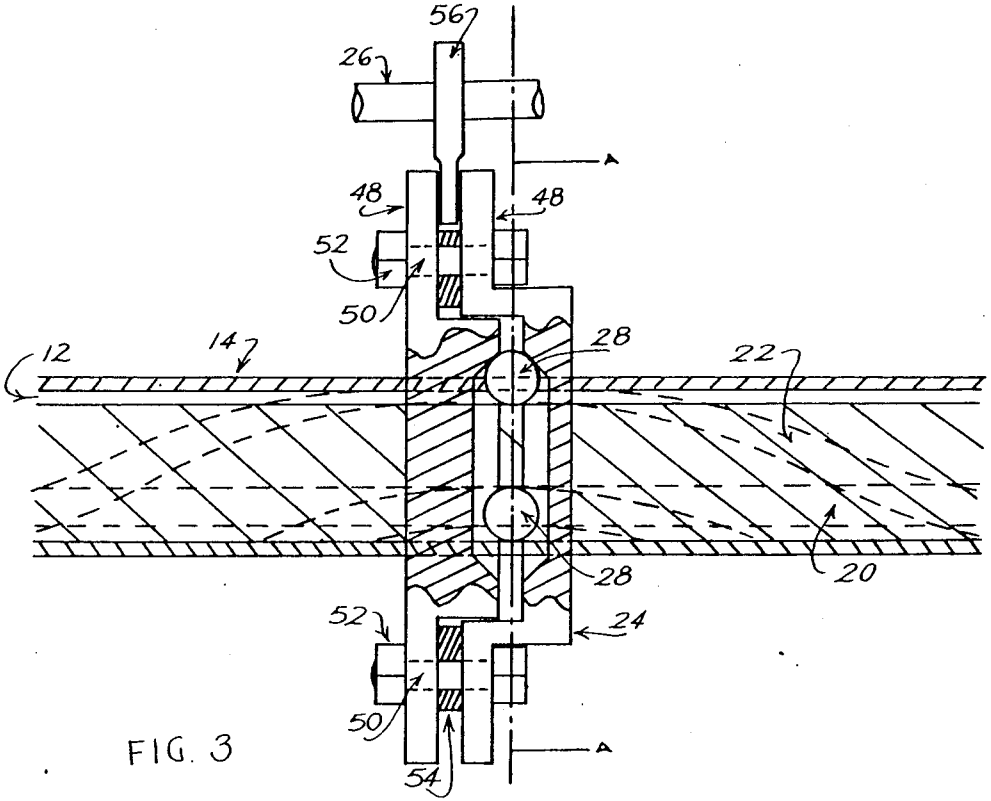
FIG. 3 is a partial longitudinal sectional view of a cam varying mechanism of the engine of FIG. 1.

The first inner shaft portion 12 contains a number of longitudinal grooves 20 whilst the second outer shaft portion contains a corresponding number of arcuate grooves 2 A collar 24 is mounted about the second outer shaft portion 14. The collar 24 is connected to a control rod 26. Further, the collar 24 is slidably mounted on the second outer shaft portion 14 and is arranged to be slid along the second outer shaft portion 14 by means of the rod 26. As can best be seen in FIGS. 3 and 4, the collar 24 contains a plurality of ball bearings 28 in a ball race 30. The number of ball bearings 28 corresponds with the number of grooves 20 and 22. Each ball bearing 28 rests in a groove 22 and also in a corresponding groove 20. Thus, when the collar 24 is slid along the second outer shaft portion 14 the latter is caused to rotate relative to the first inner shaft portion 12. Thus, the relative positions of the cam lobes 16 and 18 and the timing of the engine are changed as will be described hereinafter. The control rod 26 is connected to a timing means which will cause movement thereof in response to engine speed.

A rocker member 32 is mounted on a shaft 34 mounted on a support 36 which rests on a base 37. The rocker member 32 comprises a first end having a pair of rollers 38 rotatably mounted on a shaft 40. Each roller 38 is arranged to engage with a respective cam lobe 16 and 18. The rocker member 32 further comprises a second end having a forked portion 42. The forked portion 42 is arranged to fit snugly around the upper end of a valve member 44.

Figure 2:
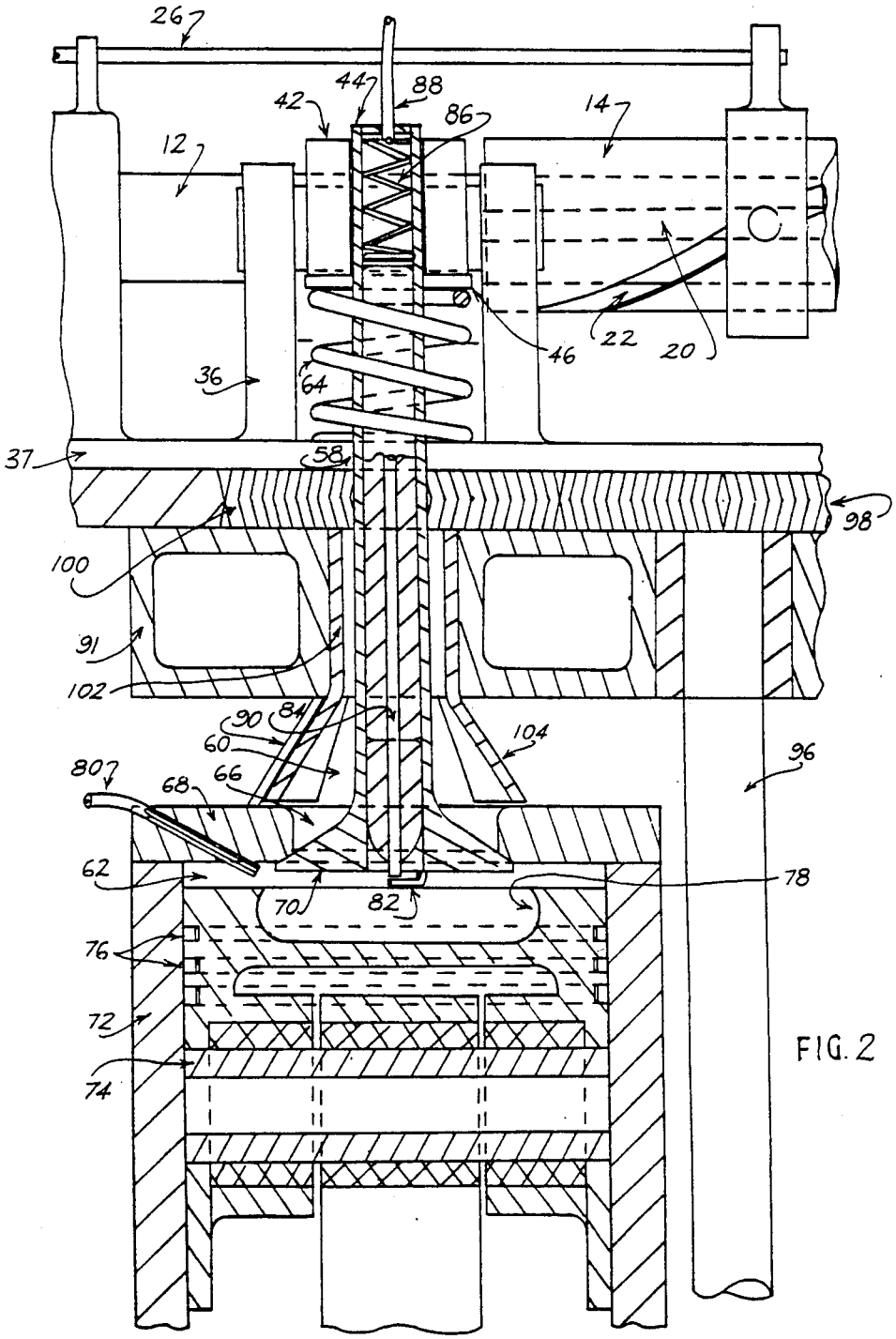
FIG. 2 is a vertical section through part of the internal combustion engine which is the subject of FIG. 1.

As can best be seen in FIG. 2, the valve member 44 comprises a flange 46 spaced from its upper end and the forked end 42 of the rocker member 32 engages with the flange 46.

Referring back to FIG. 3, it can be seen that the ball race 30 may comprise two parts which are joined together by means of annular flanges 48 connected together by threaded studs 50 which are retained in place by nuts 52 threadedly engaged with respective free ends of the studs 50. An annular spacer 54 is sandwiched between the flanges 48 when the latter are connected together.

Further, the rod 26 may be fixedly connected to a bar 56 which is connected to the collar 24 between the flanges 48 by any suitable means such as a pin extending across the gap between the flanges 48 and extending through the bar 56. Turning back to FIG. 2, it can be seen that the valve 44 comprises an outer tubular body 58. The body 58 extends through an aperture in the base 37, through an antechamber 60, containing an inlet valve and an outlet valve, and then into the upper end of a combustion chamber 62.

The valve body 58 is urged upwardly as seen in FIG. 2, by means of a coil spring 64 located between the flange 46 and the base 37. At its lower end the valve body 58 passes through an aperture 66 centrally located in a roof 68 of the combustion chamber 62. At its lowermost end the valve body 58 is splayed outwardly to form a valve head 70.

Further, the aperture 66 is formed with a valve seat at its inner end adjacent the combustion chamber 62 such that in the position shown in FIG. 2, the valve head 70 is sealingly engaged with the aperture 66.

The combustion chamber 62 comprises wall means 72 connected to the roof 70. A piston 74 is slidably mounted within the wall means 72. Further, the piston 74 is arranged to be reciprocated between a first position in which the combustion chamber 62 is of maximum volume and a second position (as seen in FIG. 2) in which the combustion chamber 62 is of minimum volume.

Further, the piston 74 is arranged to be sealingly engaged with the wall means 72 by means of piston rings 76. As can be seen in FIG. 2, the piston 74 is recessed and comprises a central recess 78 in its upper face. The recess 78 ensures that the piston 74 does not contact the valve 44 whilst enabling the engine to have a high compression ratio.

Still further, a conduit 80 leads into the upper end of the combustion chamber 62 (as seen in FIG. 2). The conduit 80 is connected to a fuel injection system which is of known type per se.

Also, a spark plug 82 is located in the valve means 44 in the combustion chamber 62. The spark plug 82 is connected to a conductor 84. The conductor 84 extends to the spark plug 82 through the tubular body 58 of the valve 44 from a spring contact 86 located in the upper end of the tubular body 58.

The contact 86 is coupled to a conduit 88 which leads to an H.T. power supply of known type.

It can be seen that the valve head 70, spark plug 82 and fuel injection means are all located in the combustion chamber above the piston 74 in its second position as seen in FIG. 2.

Figure 5:
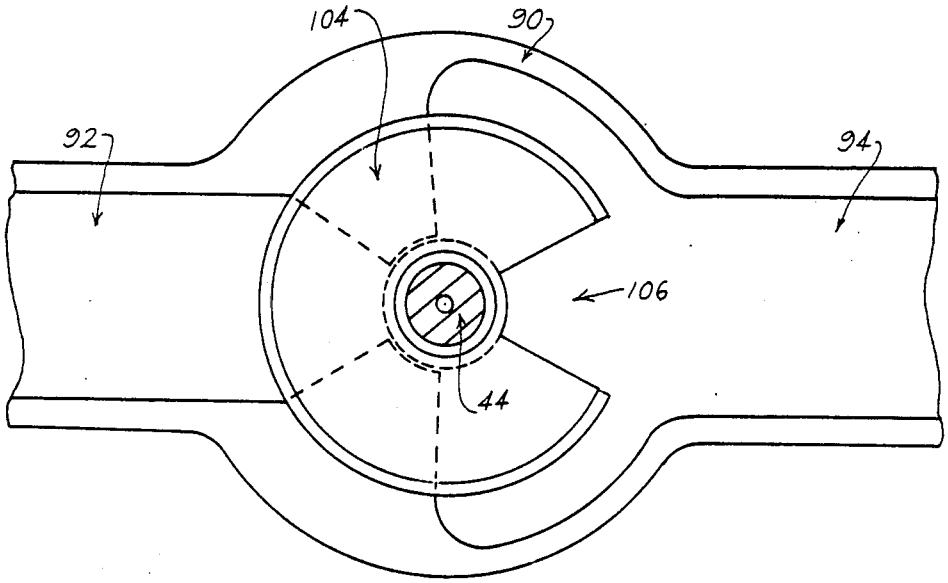
FIG. 5 is an underneath view of an antechamber of the internal combustion engine of FIG. 2.

The antechamber 60 comprises a wall 90 depending from a frame member 91 and containing an inlet port 92 and an exhaust port 94 (see FIG. 5). As can be seen in FIG. 2, an axially rotatable shaft 96 (arranged to be axially rotated by any convenient means) is arranged to rotate a pinion 98.

The pinion 98 is meshed with a pinion 100 which is arranged to rotate axially a downwardly depending tubular member 102. The tubular member 102 extends into the antechamber 60 and, within the antechamber 60 contains an outwardly flared portion 104 containing an aperture 106 (see FIG. 5). In use, the piston 74 reciprocates between its first and second positions in known manner.

The valve 44 is depressed by contact of the rocker member 32 with prominent regions of the cam lobes 16 and 18, and raised by the spring 64. The cam lobe 16 is fixed and only serves to depress the valve 44 to enable exhaust of burnt combustible mixture to take place at a predetermined point in the engine cycle. The cam lobe 18 is variable in position and enables the valve 44 to be closed by the spring 64 in variable positions dependent on engine speed or the amount of power required from the engine.

The piston 74 is initially at its second position i.e. top dead centre. From this position the piston 74 moves toward its first position. In this situation the valve 44 remains open from the previous exhaust stroke by contact of a roller 38 with a cam lobe. Simultaneously, the inlet valve in the outer chamber 60 opens by the mating of the aperture 106 with the inlet port 92, whilst the exhaust valve in the antechamber 60 is closed. By this means a charge of air is drawn into the combustion chamber 62 through the antechamber 60, and the aperture 66 in the roof of the combustion chamber 62.

During movement of the piston 74 towards its first position i.e. bottom dead centre, the valve 44 remains open. The actual closing position is determined by the speed of the engine and the requirement for combustible mixture at that speed. For example, at low engine speeds or when low engine power is required, the amount of combustible mixture required is relatively low. In this case, the position of the cam 18 is varied so that the valve 44 remains open so that after bottom dead centre some of the air which has been drawn into the combustion chamber 62 is expelled therefrom by the upward movement of the piston 74 towards top dead centre.

This cool air preferably passes through the outlet valve in the antechamber 60 since at this stage in the engine cycle the aperture 106 has commenced to mate with the exhaust port 94. It should be noted that the cam lobes 16 and 18 overlap at some point in the engine cycle adjacent bottom dead centre of the intake stroke so that both are acting on the valve 44 whereas before this only the cam lobe 16 is acting on it and subsequently only the cam lobe 18 is acting on it. The expelling of cool air past the valve 44 and the outlet valve in the antechamber cools these components so reducing the incidence of nitrogen oxide formation.

When the piston reaches a position in its upward travel where the volume of air in the combustion chamber is at the required amount, the valve 44 is allowed to close by the cam lobe 18 and the charge of air commences to be compressed. Following closure of the valve 44, an amount of fuel is injected into the combustion chamber 62 via the conduit 80. This produces a charge of combustible mixture adjacent the upper end of the combustion chamber. This charge is ignited by the spark plug 82 at a position of the piston 74 that is appropriate for the engine speed in known manner.

The central location of the spark plug 82 enables a flame front to spread efficiently to all parts of the combustion chamber 62 above the piston 74 so promoting efficient combustion.

The ignition of the combustible mixture produces hot gases of combustion that expand rapidly and push the piston 74 back towards its first position. The valve 44 is fully closed at this part of the engine cycle. Subsequently, the valve 44 is opened by the fixed cam lobe 16 to enable spent gases to be exhausted through the valve 44 on the exhaust stroke of the piston. The spent gases are also exhausted through the outlet valve in the antechamber by mating of the aperture 106 with the exhaust port 94. The piston returns to its initial position at top dead centre. Thus, it can be seen that the valve 44 is fully open on the exhaust stroke and remains fully open during the air intake stroke and and only closes when it is desired to commence compression. The cooling of the valve 44 by expelled air described above, allows the use of a recessed high compression piston as shown, since the cooled valve 44 has a lesser tendency to promote detonation.

Further, the closing of the valve 44 prior to injection of fuel ensures that significant amounts of unburnt hydrocarbons cannot be expelled prior to ignition.

Figure 6:
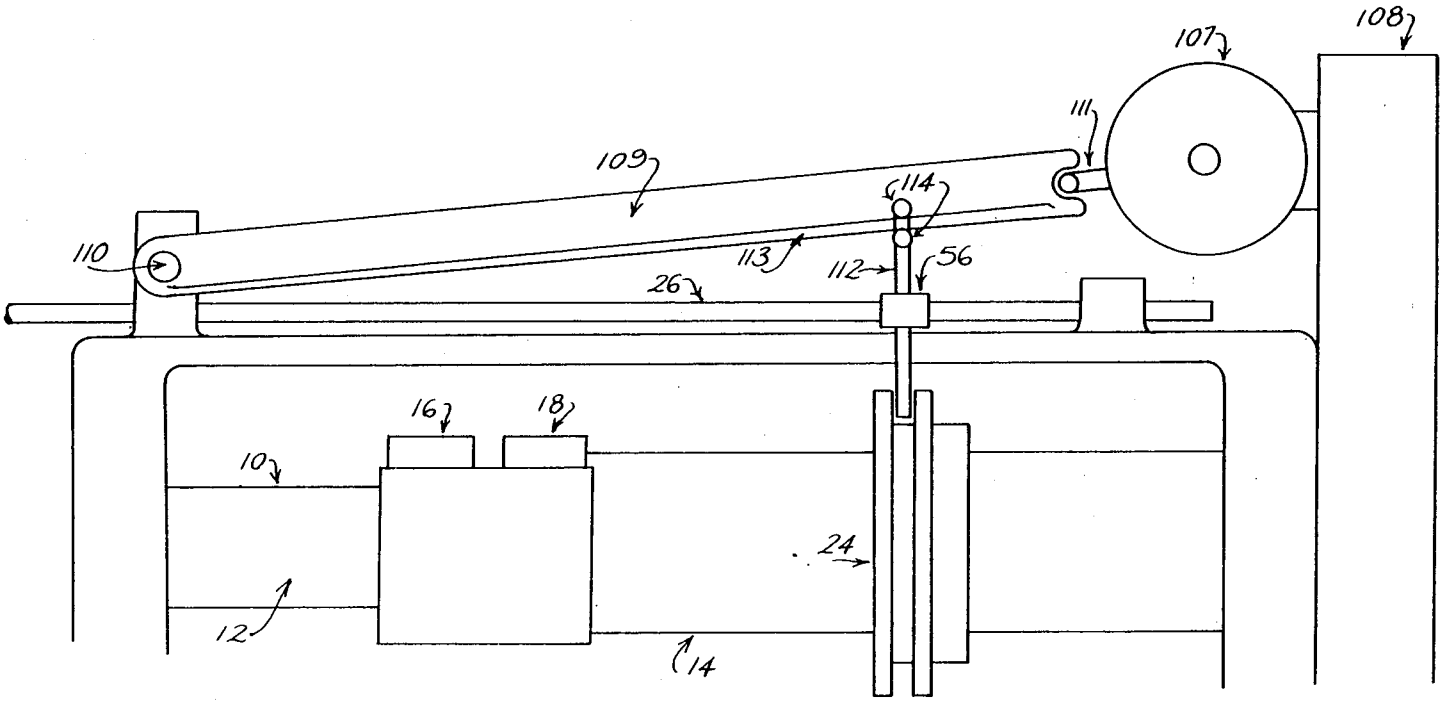
FIG. 6 is a schematic plan view of an internal combustion engine in accordance with the present invention provided with means for coordinating the operation of a valve timing means and a fuel pump.

In FIG. 6, there is shown an arrangement similar to that shown in FIGS. 1 to 4 for moving a rod 26 and thereby altering the relative pistons of a pair of cams 16 and 18. Like reference numerals denote like parts.

In addition in FIG. 6, there is shown a fuel pump 107 which is driven by gear means 108. There is a bar 109 which is pivotally mounted on a pivot 110 at one end and operatively connected to a control means 111 of the fuel pump 107 at the other end. Intermediate its ends the bar 109 is connected to the bar 56 which is connected to the control rod 26, by means of a pin 112 which is arranged to move along a flange 113 of the bar 109 by means of rollers 114. Thus, if the control rod 26 is moved laterally to vary the relative positions of the cams 16 and 18, the inclination of the bar 109 is altered correspondingly. This in turn alters the position of the control means 111 of the fuel pump 107 and so the amount of fuel pumped out on each cycle of the engine is varied in accordance with the movement of the control rod 26.

The movement of the control rod 26 can be controlled by a computer means which senses such parameters as engine load and engine speed, determines the quantity of fuel and air required and adjusts the position of the control rod 26 accordingly. A suitable commercially available system of this type is the Bosch "Jetronic" which could be adapted for use with the present invention.

The present invention is described above with particular reference to one form of engine using a combustion chamber with a single inlet-outlet valve, but it is to be understood that the inventive concept can be used with other forms of engine. For example, as mentioned above the single inlet-outlet valve could be replaced by a plurality of inlet-outlet valves operated in equivalent manner to the single valve. Also, the rotary valve in the antechamber 60 could be replaced by poppet valves or other valve means.

In FIGS. 7, 8, 9 and 10, there is shown an hydraulically actuated valve control assembly which can be used in place of the mechanical assembly shown in FIGS. 1 to 5 to alter the positions of a cam.

In FIGS. 7, 8, 9 and 10, there is shown an hydraulically actuated valve control assembly 200 comprising a pair of stationary cylindrical sleeves 202 and 204 into which the assembly 200 is rotatably mounted.

The assembly 200 comprises a first end 206 having a relatively narrow cylindrical portion 207 mounted within the sleeve 202. The portion 207 comprises a plurality of spaced ring seals 208. It also comprises an annular groove 210 between a first pair of seals 208 and a second annular groove 212 between a second pair of seals 208. Each groove 210 and 212 has a respective hydraulic fluid supply line 214.

As can be seen most clearly in relation to the groove 212, each groove 210 and 212 comprises a pair of ports.

Figure 8:
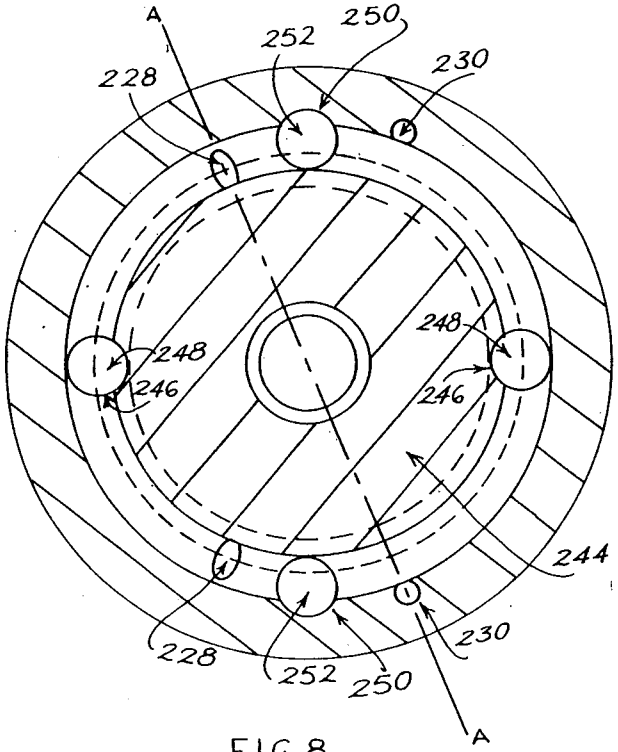
FIG. 8 is a section along the line A—A of FIG. 7.

A first port 216 is connected to a conduit 218 which leads directly to a chamber 220. A second port 222 in each case also leads to the chamber 220 through a conduit 224 via a spring biased check valve 226. Only the port 222 and associated components for the groove 212 can be seen in the drawings. As can be seen in FIG. 8, the conduits 218 enter the chamber 220 through orifices 228 whilst the conduits 224 enter the chamber 220 through orifices 230. The chamber 220 is defined by an annular ring 232 which abuts the end 206 and a second end 234 of the assembly 200. The second end 234 comprises a relatively narrow cylindrical portion 236 within the sleeve 204 and an enlarged circular portion 238 which abuts the ring 232 to complete the chamber 220.

The ends 206 and 234 and the ring 232 are joined together by any suitable means to enable them to be rotated together.

A rotatable hollow cam shaft 240 extends into an axial hole in the centre of the first end 206 of the assembly 200 and extends through the chamber 220 and into a corresponding axial hole in the second end 234. Within the second end 234 the cam shaft 240 contains a longitudinally extending open ended slot 242.

A substantially circular control member 244 is mounted on the shaft 240 for rotation therewith. The control member 244 is located in the chamber 220 in abutting relation to the adjacent portions of the ends 206 and 232. As can best be seen in FIG. 8, the control member 244 contains a pair of opposed recesses 246. The recesses 246 are arranged to receive a respective cylindrical roller 248 which is rollably located between the recess 246 and the inner circular wall of the chamber 220 defined by the ring 232. Further, as can also best be seen in FIG. 8, the inner wall of the control chamber 220 also contains a pair of opposed recesses 250 which are spaced from the recesses 246. A respective cylindrical roller 252 is rollably located in each recess 250 between the outer circular wall of the control member 244 and the recess 250. The provision of the roller 248 and 252 together with the control member 244 effectively divides the chamber 220 into four compartments. Each compartment of the chamber 220 is connected to a respective orifice 228 or 230 as can be seen in FIG. 8.

Figure 9:
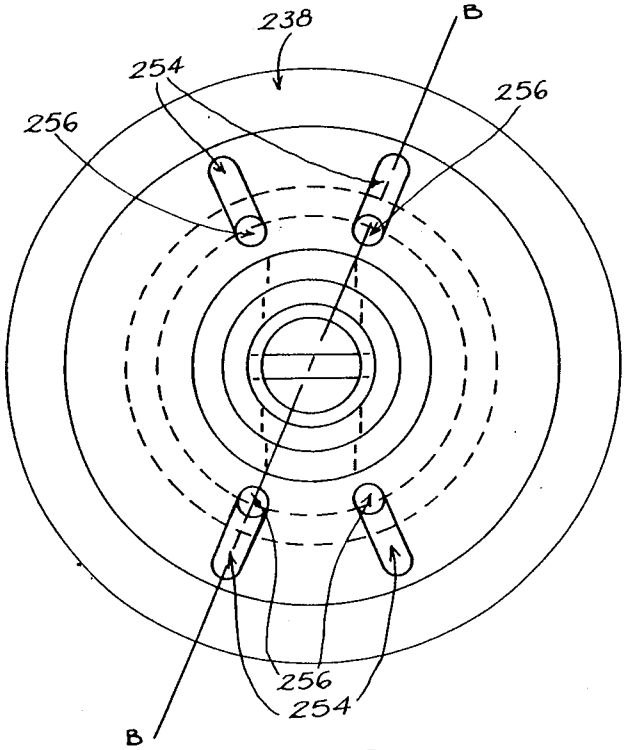
FIG. 9 is a section along the line B—B of FIG. 7.

As can best be seen in FIG. 9, the portion 238 of the second end 234 contains four elongated, radially extending recesses 254 which are connected at their radially inner ends to respective conduits 256. Each recess 254 corresponds with a respective orifice 228 or 230. The recesses 254 are radially elongated so that their outer ends are not obscured by the control member 244 and so that communication with the recesses 254 is not blocked by the control member 244. Each recess 254 is connected to a corresponding conduit 256 as can be seen in FIG. 7. Further, a second hollow shaft 258 extends into the axial aperture in the portion 236 of the second end 234. The shaft 258 fits about the shaft 240. Further, a pin 260 extends across the foremost end of the shaft 258 and is fitted into the slot 242. Thus, the shafts 240 and 258 are arranged for rotation together. The shaft 258 also contains a pair of helically orientated slots 259 adjacent its foremost end as can best be seen in FIGS. 10*a* and 10*b*. The helical slots 259 are cut in opposing sides of the shaft 258 and one is larger than the other as can be seen by comparing FIGS. 10*a* and 10*b*.

The portion 236 also contains a cylindrical sleeve 262 which is mounted for rotation with the control member 244. The cylindrical sleeve 262 is provided with two equal pairs of helically orientated slots 263 on opposite sides of the sleeve 262 as can best be seen in FIGS. 10*c* and 10*d*. The pairs of helically orientated slots 263 are cut in the sleeve 262 and each such pair corresponds with a respective slot 259 in the shaft 258. In use, when the engine is moving under constant conditions such as at constant speed and load, the sleeve 262 is orientated in such manner that the wide slot 259 in the shaft 258 is disposed symmetrically between the corresponding pair of slots 263 in the sleeve 262. In other words, the wide slot 259 is disposed across the gap between the corresponding pair of slots 263 so that an equal area of the wide slot 259 is overlapping with each slot 263 of the corresponding pair.

Similarly, the narrow slot 259 in the shaft 258 is disposed between the corresponding pair of slots in the sleeve 262 so that no part of its area is overlapping with either slot of the corresponding pair.

In this position, hydraulic fluid is pumped through the conduits 214 into the annular slots 210 and 212. This fluid flows through each port 216, along the corresponding conduit 218 and through an orifice 228 into a respective compartment of the chamber 220. From there it flows through a corresponding conduit 256 to one of the helical slots 263 in the sleeve 262 corresponding with the wide slot 259 in the shaft 258. As there is a symmetrical window to each of the slots in the sleeve 262 the hydraulic fluid drains into the shaft 258 and returns to a sump without creating any forces in the chamber 220.

Similarly, oil flows through the ports 222, associated conduits 224 and associated orifices 230 to enter corresponding compartments of the chamber 220. The oil from these compartments then attempts to flow through the corresponding conduits 256. However, this flow is blocked because the narrow slot 259 in the shaft 258 is lying completely between the corresponding slots 263 in the sleeve 262 and no window is presented to the corresponding pair of slots 263. Further, the check valves 226 prevent reverse flow of hydraulic fluid. Thus, the compartments of the chamber 220 corresponding to the ports 222 become filled with fluid which cannot escape. This retains the control member 244 in a static position.

However, if the engine load or speed or other parameter is changed, the shaft 258 is moved longitudinally so that the window to one of the slots 263 in the shaft 262 corresponding to the wide slot 259 in the shaft 258 is increased whilst the other is decreased. Similarly, a window is opened to one of the slots 263 in the sleeve 262 corresponding to the narrow slot 259 in the shaft 258. Thus, fluid can now flow through an orifice 230 and its corresponding conduit 257 through the helical slots into the shaft 258. However, the other flow through an orifice 230 is still blocked. Thus, the control member 244 and the sleeve 262 rotate relative to the shaft 258 to reduce the hydraulic imbalance which is now created between the compartments of the chamber 220. Rotation ceases when a state of balance equivalent to the initial state is achieved. The cam shaft 240 is connected to the control member 244 and thus relative rotation of the control member 244 causes relative movement of the cam shaft 240 and thus alters the timing of a valve controlled by the cam shaft 240. In the context of the present invention the cam shaft 240 can be used to control the closing of the control valve 44 as described herein.

The sequence of valve events in an engine in accordance with the present invention using poppet valves in the antechamber 60 is illustrated in FIGS. 11 to 18 of the accompanying drawings. The engine illustrated in FIGS. 9 to 16 has a single control valve 44, an antechamber 60, a combustion chamber 62 and a piston 74. The antechamber 60 comprises an outlet port 120 provided with an outlet poppet valve 122 and an inlet port 124 provided with an inlet poppet valve 126. In the position shown in FIG. 11, the piston 74 is at top dead centre, the outlet valve 122 is open, the inlet valve 126 is closed and the control valve 44 is closed.

In this position a charge of air from the inlet valve 126 has been compressed by the piston 74 in the combustion chamber 62 and a charge of fuel has been injected into the combustion chamber 62. At or about this position the compressed air-fuel charge is ignited which causes the charge to undergo a rapid expansion in known manner. This expansion of the charge pushes the piston 74 towards bottom dead centre.

Figure 12:
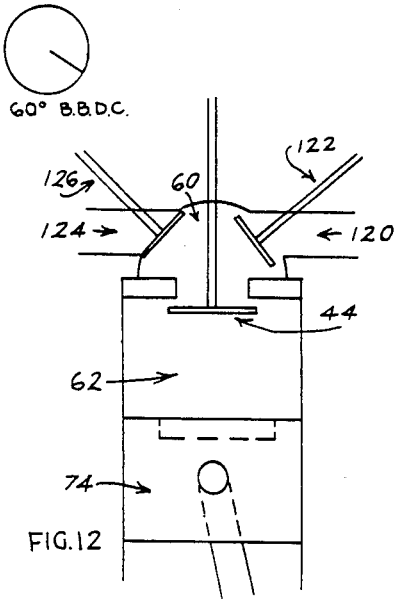
Figure 13:
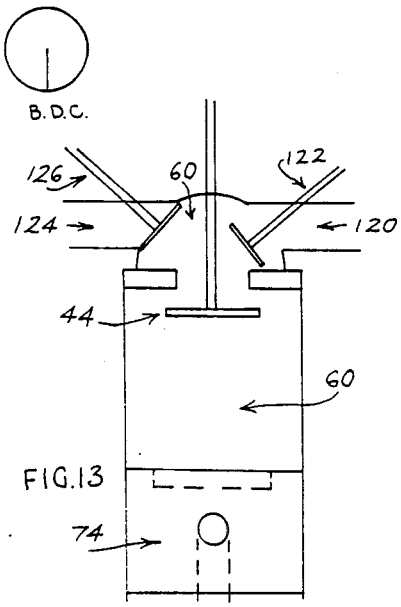
Figure 14:
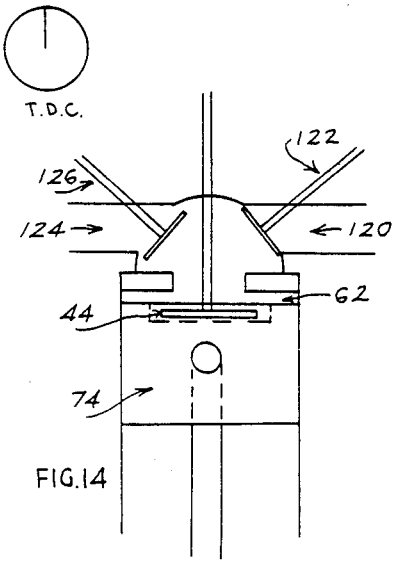

In the position shown in FIG. 12, the piston 74 is at 60° before bottom dead centre and the control valve 44 has just commenced to open whilst the outlet valve 122 remains open. In the position shown in FIG. 13, the piston 74 has reached bottom dead centre and the control valve 44 and the outlet valve 122 remain open.

Figure 15:
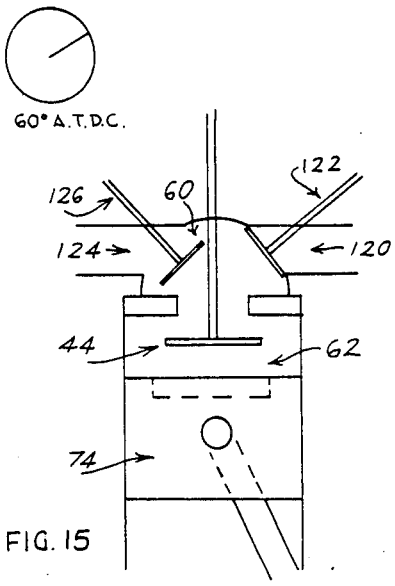
Figure 16:
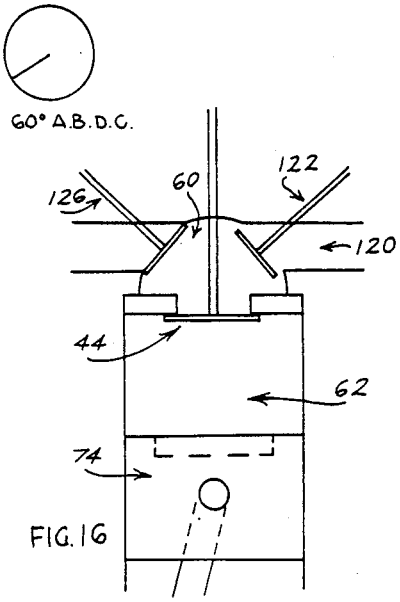

The piston 74 then returns towards top dead centre and in so doing expels the spent ignited charge through the control valve 44 and the outlet valve 122 which remain open. In FIG. 14, the piston 74 is again at top dead centre and the spent, ignited charge has been expelled. The outlet valve 122 having closed after completion of expulsion of the spent charge and the inlet valve 126 has opened. The piston 74 now commences to return to bottom dead centre and in so doing draws in a charge of air through the inlet valve 126 and the inlet port 124. As shown in FIG. 15, at 60° after top dead centre, the inlet valve 126 and the control valve 44 are open. At or about bottom dead centre, the inlet valve 126 closes and the outlet valve 122 opens whilst the control valve 44 remains open. Thus, excess air is expelled through the control valve 44 and the outlet valve 122. This situation is maintained for a desired amount of the return stroke of the piston 74 to top dead centre dependent on such factors as engine load and engine speed. For example, at full throttle, the control valve 44 may close at about 60° after bottom dead centre as shown in FIG. 16, whereas at half throttle the control valve 44 may close at about 90° after bottom dead centre as shown in FIG. 17, whereas at tick over, the control valve 44 may close at 30° before top dead centre as shown in FIG. 18. After the control valve 44 has closed the remaining charge of air is compressed and an appropriate amount of fuel is injected into the combustion chamber 62 as described above, prior to ignition.

The cycle of FIGS. 11 to 18 is then repeated. The single inlet-outlet control valve 44 can be replaced by a plurality of valves 140 as shown in FIGS. 19 and 20. The valves 140 are arranged to be simultaneously actuated by a rocker arm 142 which engages stems of all four valves 140. In other respects the valves 140 are equivalent in operation to the valve 44. However, the use of a plurality of valves enables them to be symmetrically disposed in the roof of the combustion chamber about a centrally located spark plug 144 as shown in FIG. 19.

Modifications and variations such as would be apparent to a skilled addressee are deemed within the scope of the present invention.

I claim:

1. A four stroke internal combustion engine comprising; a combustion chamber, a piston mounted within the combustion chamber and arranged to be sealingly engaged with walls of the combustion chamber, the piston being arranged for reciprocating motion between a first position in which combustion chamber is of maximum volume and a second position in which the combustion chamber is of mininum volume, wherein the combustion chamber further comprises an inlet-outlet control valve means in a region of the combustion chamber within the minimum volume defined by the piston in its second position, a fluid fuel injection means in a region of the combustion chamber within the minimum volume defined by the piston in its second position, a combustible mixture ignition means located in the region of the combustion chamber within the minimum volume defined by the piston in its second position, and the engine comprises an antechamber an inlet valve means and spent combustible mixture outlet valve means, which antechamber is in communication with the inlet-outlet control valve means of the combustion chamber, control valve timing means for closing of the control valve at a point on the compression stroke of the engine and for expelling excess air prior to said closing, and antechamber inlet valve timing means and antechamber outlet valve timing means for closing said inlet valve and opening said exhaust valve whilst said excess air is being expelled through said exhaust valve.

2. An internal combustion engine as claimed in claim 1, in which the combustion chamber comprises a roof portion above the piston in all postions thereof, and the control valve means is located centrally of the roof portion.

3. An internal combustion engine according to claim 2, in which the control valve means is a single valve member.

4. An internal combustion engine according to claim 2, in which the ignition means is located in the roof portion.

5. An internal combustion engine according to claim 2, in which the control valve means is a single valve member and the ignition means is located in the single valve member.

6. An internal combustion engine according to claim 1, wherein means is provided for varying the closing position of the control valve so as to vary the amount of excess air expelled in accordance with engine parameters.

7. An internal combustion engine according to claim 1, in which the control valve timing means is provided with mechanical actuation means.

8. An internal combustion engine according to claim 1, in which the control valve timing means is provided with hydraulic actuation means.

9. An internal combustion engine according to claim 1, in which the inlet and outlet means of the antechamber is in the form of rotary valve means.

10. An internal combustion engine according to claim 1, in which the inlet and outlet means of the antechamber is in the form of poppet valve means.

11. An internal combustion engine according to claim 1, in which the control valve is in the form of a poppet valve.

12. An internal combustion engine according to claim 1, in which the control valve means is a plurality of valve members.

* * * * *